US008151681B2

(12) United States Patent
Lassnig et al.

(10) Patent No.: US 8,151,681 B2
(45) Date of Patent: Apr. 10, 2012

(54) TRANSPORT DEVICE FOR A HOOP KNIFE AND METHODS FOR MOUNTING AND DISMANTLING A HOOP KNIFE

(75) Inventors: Hans Lassnig, Esslingen (DE); Markus Hoffmann, Groembach (DE)

(73) Assignee: Fortuna Spezialmaschinen GmbH, Weil der Stadt (DE)

( * ) Notice: Subject to any disclaimer, the term of this patent is extended or adjusted under 35 U.S.C. 154(b) by 1209 days.

(21) Appl. No.: 11/731,330

(22) Filed: Mar. 30, 2007

(65) Prior Publication Data

US 2007/0240553 A1 Oct. 18, 2007

(30) Foreign Application Priority Data

Mar. 31, 2006 (DE) ..... 10 2006 016 254

(51) Int. Cl.
*B26B 27/00* (2006.01)
*B26D 3/00* (2006.01)

(52) U.S. Cl. ..... 83/871; 30/380; 30/390; 30/298.4; 83/954

(58) Field of Classification Search ..... 206/349, 206/207, 493; 33/202; 30/298.4, 380, 504, 30/390; 220/735; 248/309.1; 83/788, 816, 83/871, 954, 820, 581.1, 814; 408/239 R; 483/16, 30, 31
See application file for complete search history.

(56) References Cited

U.S. PATENT DOCUMENTS 4,141,142 A * 2/1979 Karubian ..... 30/380
4,365,420 A * 12/1982 Walden ..... 33/202
4,622,748 A * 11/1986 Binder et al. ..... 30/380
4,905,948 A * 3/1990 Indorf ..... 248/309.1
6,746,187 B2 * 6/2004 Alm ..... 408/241 R
6,868,966 B2 * 3/2005 German, III ..... 206/349
7,066,327 B2 * 6/2006 Baublitz et al. ..... 206/349
7,458,920 B2 * 12/2008 Hallar ..... 482/104
7,487,872 B2 * 2/2009 Curtsinger et al. ..... 206/349
7,624,862 B1 * 12/2009 Pleggenkuhle ..... 206/349
7,641,047 B1 * 1/2010 Boyer, Jr. ..... 206/349

FOREIGN PATENT DOCUMENTS

DE 328104 10/1920
DE 28 117 38 A1 9/1979
DE 3815130 A1 11/1989
DE 44 25 771 A1 1/1996

* cited by examiner

*Primary Examiner* — Boyer D Ashley
*Assistant Examiner* — Omar Flores-Sánchez
(74) *Attorney, Agent, or Firm* — Bracewell & Giuliani LLP

(57) ABSTRACT

An endless rotation hoop knife for a splitting machine including a front end embodied as a cutting edge and at least two openings for accommodating retaining members. The invention also discloses a transport device for a rotation hoop knife, including a housing and at least two retaining members which are configured to engage in openings in the rotation hoop knife. The invention further relates to methods for safe mounting and dismantling of a rotation hoop knife, in particular of a sharp rotation hoop knife. Due to the rotation hoop knife being provided with openings for accommodating retaining members, it is now possible for the rotation hoop knife by to be held by retaining members which engage the openings. In this way, when the rotation hoop knife is released on the splitting machine, the rotation hoop knife is reliably held by the retaining members which engage the openings. The rotation hoop knife can thus be taken off the splitting machine without the rotation hoop knife itself, in particular the cutting edge, having to be touched.

8 Claims, 3 Drawing Sheets

TRANSPORT DEVICE FOR A HOOP KNIFE AND METHODS FOR MOUNTING AND DISMANTLING A HOOP KNIFE

RELATED APPLICATION

This application claims priority of German patent application serial number 10 2006 016 254.4 filed on Mar. 31, 2006, the subject matter of which is fully incorporated by reference.

BACKGROUND OF THE INVENTION

The present invention relates to an endless rotation hoop knife for a splitting machine.

The invention also relates to a transport device for a rotation hoop knife, in particular for a sharp rotation hoop knife. By the expression "sharp" is meant here that the blade is either sharpened or that the blade is still so sharp after operational use that cut wounds may occur unless additional protective measures are taken.

Finally, the invention relates also to methods for mounting and dismantling a rotation hoop knife, in particular a sharp rotation hoop knife.

A rotation hoop knife of the kind mentioned at the outset is known from DE 38 15 130 A1. In addition, German patent 328104 discloses a rotation hoop knife comprising holes which are engaged by driving pins of a drive wheel.

A rotation hoop knife of the known type is used as a cutting tool in a splitting machine. The rotation hoop knife is usually embodied in the form of an endless steel strip which runs over two discs, of which at least one is driven.

During the splitting process, a cloth-like piece of leather, for example, is guided against the rotation hoop knife circulating at high speed in order to split the piece of leather into two "splits" that are less thick.

To ensure uniformly high quality of splitting and to avoid the material tearing rather than splitting, the rotation hoop knife must have a sharp cutting edge. On the other hand, it is essential to prevent injuries occurring when handling the sharp rotation hoop knife.

The following procedure has become established as a way of meeting these requirements: When mounting the rotation hoop knife, it is first placed in blunt form onto the machine and tensioned. The rotation hoop knife is then driven and sharpened by means of a grinding device provided on the splitting machine. The grinding device is also used for regular sharpening of the rotation hoop knife during operation of the splitting machine.

If the rotation hoop knife can no longer be sharpened because its width is less than that required, and the rotation hoop knife must therefore be dismantled from the machine, it is essential to remember that the rotation hoop knife is usually still so sharp that cut wounds can occur. For this reason, the rotation hoop knife is blunted before it is taken off. The rotation hoop knife may not be removed from the splitting machine until this procedure has been completed.

Although this approach is widespread and practicable in principle, problems with certain applications arise in practice.

Metal fragments, or dust particles ranging from large to extremely fine can ensue not only when sharpening, but also when blunting a rotation hoop knife. This is not acceptable, however, in view of the standards of cleanliness for applications in the food industry or in medical technology. In such a case, especially when cleanroom conditions must be complied with, it would therefore be advantageous if sharpening of the rotation hoop knife were not carried out on the splitting machine.

However, this means that the rotation hoop knife would have to be transferred in the sharpened state from the grinding apparatus to the splitting machine. Given that the rotation hoop knife is usually ground until it is razor sharp, the slightest inattentiveness can result in the user incurring severe cut wounds. Such a procedure therefore requires suitable measures to prevent any risk of injury.

SUMMARY OF THE INVENTION

It is a first object of the present invention to disclose a cost-efficient endless rotation hoop knife that can be placed on a splitting machine after having been sharpened without any cutting risk to a user.

It is a second object of the invention to disclose a transport device for a sharpened endless rotation hoop knife.

It is a third object of the invention to disclose a transport device suitable for transporting an endless rotation hoop knife between a splitting machine and a sharpening device for sharpening the endless rotation hoop knife.

It is a forth object of the invention to disclose a transport device adapted for receiving a sharpened endless rotation hoop knife therein and for cleaning the knife therein and for attaching the sharpened and clean knife onto a splitting machine.

It is a fifth object of the invention to disclose a transport device for receiving a sharpened endless rotation hoop knife therein that allows for cleaning the knife within the transport device under cleanroom conditions.

According to the invention these and other objects are achieved by a transport device for an endless rotation hoop knife, in particular for a sharp rotation hoop knife, that comprises a housing and at least two retaining members which are configured to engage in openings in the rotation hoop knife.

A rotation hoop knife suitable for use with such a transport device comprises at least two openings which can be engaged by the retaining members of the transport device.

The object of the invention is further achieved by a method for dismantling a rotation hoop knife, said method comprising the following steps:

- placing a transport device over the rotation hoop knife held on two discs in the splitting machine, in such a way that the rotation hoop knife is at least partially enclosed by a housing of the transport device;
- fixing at least two retaining members held on the housing to openings in the rotation hoop knife;
- tensioning the rotation hoop knife by means of the retaining members at the openings;
- transferring the rotation hoop knife in a tensioned state from the discs of the splitting machine onto the retaining members; and
- removing the transport device, including the rotation hoop knife, from the splitting machine.

Finally, the object of the invention is also achieved by a method for mounting a rotation hoop knife, the method comprising the following steps:

- providing a transport device inside which a rotation hoop knife is held in a tensioned state at openings in the rotation hoop knife by at least two retaining members which are accommodated in openings in the rotation hoop knife and accommodated on a housing;
- placing the transport device over two discs of the splitting machine in such a manner that the rotation hoop knife is positioned radially spaced apart from or partially touching peripheral surfaces of the discs;

transferring the rotation hoop knife in a tensioned state from the retaining members onto the discs of the splitting machine;

de-tensioning the rotation hoop knife by means of the retaining members at the openings;

removing the retaining members from the openings in the rotation hoop knife; and removing the transport device without the rotation hoop knife from the splitting machine.

One special aspect of the invention is that the steps which previously required the rotation hoop knife being touched can now be carried out without the user have to touch the rotation hoop knife. It is also possible to prevent the rotation hoop knife touching the transport device during transportation, cleaning or any other type of handling. It is possible, in particular, to enable especially thorough cleaning, for example, and, if necessary, the sterilization of the rotation hoop knife inside the transport device.

To simplify understanding of the following explanations, the following description refers by way of example to a splitting machine. However, it is noted that the rotation hoop knife, the transport device and the methods can also be applied to other devices, for example to a suitably configured grinding machine that can accommodate a rotation hoop knife on two discs.

Due to the rotation hoop knife being provided with openings for accommodating retaining members, it is now possible for the rotation hoop knife by to be held by retaining members which engage in or are introduced into the openings. In this way, when the rotation hoop knife is detached from the splitting machine, the rotation hoop knife is reliably held by the retaining members which engage in the openings. The rotation hoop knife can thus be taken off the splitting machine without the rotation hoop knife itself, in particular the cutting edge, having to be touched.

In the same way, a sharpened, sterilized rotation hoop knife can be mounted on the splitting machine without the user having to touch the rotation hoop knife itself.

According to the invention, a rotation hoop knife can be dismantled as follows. The rotation hoop knife is initially in the mounted and tensioned state on the splitting machine. To dismantle the rotation hoop knife, a transport device is first placed over the rotation hoop knife. A housing element of the transport device encloses the rotation hoop knife in the process, in such a way that the user can no longer come into contact now with the cutting edge of the rotation hoop knife.

In order to prepare transferal of the rotation hoop knife from the splitting machine to the transport device, the retaining members now engage in openings in the rotation hoop knife. In a further step, the rotation hoop knife is tensioned by means of the retaining members at the openings. This tensioning ensures that the rotation hoop knife remains in a specified form and does not simply return to its resting state, which is normally circular. The rotation hoop knife is now transferred in a tensioned state from the discs of the splitting machine onto the retaining members.

The transport device, including the rotation hoop knife supported by the retaining members, can now be removed from the splitting machine.

In order to mount a rotation hoop knife which is held in a transport device, the steps specified above are performed in reverse order. This means that a transport device containing a rotation hoop knife held therein is first placed over two discs of the splitting machine in such a manner that the rotation hoop knife is positioned radially spaced apart from or partially touching peripheral surfaces of said discs.

The rotation hoop knife is transferred in a tensioned state from the retaining members onto the discs of the splitting machine, the rotation hoop knife is de-tensioned by means of the retaining members, the retaining members are removed and the transport device is taken off without the rotation hoop knife. It is not necessary for the rotation hoop knife to be touched in this process, so the rotation hoop knife can be mounted in a sterile state.

The longitudinally tensioned shape inside the transport device also facilitates sterilization in an autoclave. Thermal tensions which may arise during treatment in the autoclave do not play any role because the rotation hoop knife is held in the tensioned state.

The object specified above is therefore completely accomplished.

In one configuration of the invention, the rotation hoop knife has at least two pairs of openings for receiving one retaining member in each pair.

A pair of openings is to be understood as two openings that co-operate with the same retaining member when the rotation hoop knife is held in the transport device. A pair of openings can thus be mentally assigned to one retaining member, even when the rotation hoop knife is outside the transport device.

A pair of openings is assigned particularly whenever two openings are in approximately opposite positions in relation to a longitudinal axis of the rotation hoop knife. The longitudinal axis of the rotation hoop knife is to be understood here as that axis which runs parallel to the longest extension of the rotation hoop knife when the rotation hoop knife is mounted on the splitting machine. In a splitting machine with two discs, the longitudinal axis is the straight line through the centers of the two discs.

A retaining member can have two ends, of which the first end engages in a first opening of the pair and the second end engages in the second opening of the pair.

In another embodiment of the invention, the openings are embodied as holes.

This enables the rotation hoop knife to be held simply and securely in relation to the retaining member. The cross-section of the hole can be of any shape, in principle. However, advantages in respect of stability and production are expected when the holes are circular in shape, in particular as drilled holes. It is particularly advantageous, when the central axes of the holes are substantially parallel to a line perpendicular to the plane of the rotation hoop knife. It has been found that the holes do not cause any significant impairment of the stability and capability of the rotation hoop knife.

In another configuration of the invention, the openings are disposed in the middle between the cutting edge and the opposite front end of the rotation hoop knife, or on that half of the rotation hoop knife which is remote from the cutting edge.

If the openings in the middle between the cutting edge and the opposite front end of the rotation hoop knife are chosen, the result is good mechanical stability and balanced receiving of the rotation hoop knife in the tensioned state.

When, in contrast, the openings are disposed on that half of the rotation hoop knife remote from the cutting edge, it is possible to minimize or prevent the openings from exerting any potential mechanical effects on the cutting edge.

In yet another configuration of the invention, the transport device has a clamping member for receiving the rotation hoop knife inside the housing.

In this way, it is possible to define the shape of the rotation hoop knife inside the transport device particularly well. It is also possible to prevent this shape from changing during transportation, cleaning or any other form of treatment, for example as a result of shocks or thermal expansion (and touching the housing, for example), or to prevent the rotation hoop knife from detaching itself from its holder.

In another configuration of the invention, the rotation hoop knife in the transportable state is held solely at the openings in the rotation hoop knife by means of the retaining members, without touching the housing.

The expression "transportable state" is to be understood as the state when the rotation hoop knife is held by the retaining member and is no longer mounted to a device. The advantage of such an embodiment is that the rotation hoop knife can be cleaned and sterilized very well. With the exception of the minute, almost punctiform points of contact, each region of the rotation hoop knife is exposed and can be well cleaned and sterilized. It is possible, in particular, to bring the rotation hoop knife into an autoclave by means of the transport device.

In another configuration of the invention, the retaining members each co-operate with a pair of openings in order to hold the rotation hoop knife.

In this way, the rotation hoop knife can be held reliably inside the transport device with rather little effort.

In another configuration of the invention, the retaining members are detachably accommodated in the housing element and are each preferably guided in cutouts in the housing.

In this embodiment, the retaining members can be separated from the transport device. This enables the fixing and detaching of the rotation hoop knife in relation to the transport device to be handled in a particularly simple manner. If the retaining member is now introduced into the housing, the retaining member also passes through the respective openings in the rotation hoop knife. In the preferred embodiment, the retaining members are then also guided in cutouts in the housing. This procedure is simple and cost-efficient.

In another configuration of the invention, the retaining members are embodied as elongate rod-shaped members.

This enables them to interact easily with the housing, with simple handling. Such retaining members can be guided in a simple manner through the openings in the rotation hoop knife and inserted into cutouts on the housing.

In another configuration of the invention, the retaining members each have a peripheral groove at their ends which engage the openings in the rotation hoop knife.

The peripheral groove on a retaining member co-operates with the edge of an allocated opening, in that the edge comes to lie in the peripheral groove when the rotation hoop knife is tensioned. A displacement of the rotation hoop knife relative to the retaining members is then possible only with very limited play within the peripheral groove, if movement of the rotation hoop knife is not already prevented due to the tensioning force. In this way, the position of the rotation hoop knife can be securely fixed.

In another configuration of the invention, the retaining members are guided substantially parallel to each other in the housing.

With this embodiment, insertion and removal of the retaining members can be simplified.

In another configuration of the invention, the clamping member is configured for substantially parallel displacement of the retaining members relative to each other.

By means of this parallel displacement, the clamping member can tension the rotation hoop knife in a simple manner. In order to tension the rotation hoop knife, the retaining members are moved away from each other, i.e. the distance between the retaining members is increased.

Since the rotation hoop knife consists of a material that has only a very small elasticity in the longitudinal direction, it is not the actual displacement path of the retaining members relative to each other that is of most relevance for the tension of the rotation hoop knife. The factor to consider is the force which is transferred by the clamping member to the rotation hoop knife by means of the retaining members.

In order to de-tension the rotation hoop knife in relation to the transport device during or after mounting the rotation hoop knife on the splitting machine , the tensioning device is de-tensioned. Due to the counterforce exerted by the rotation hoop knife, the retaining members move towards each other, but only to a slight extent, as explained above.

In another configuration of the invention, the clamping member is configured as a pivotable yoke comprising a grip portion and a lever portion.

This enables the clamping member described in the foregoing to be implemented in a cost-efficient and simple manner. The force exerted on the retaining members by a yoke embodied as a wire yoke is sufficient for many applications. If a greater tensioning force is desired or necessary, this can be achieved by a more stable or reinforced yoke design. The elastic property of the (wire) yoke is advantageous for compensating the stresses and strains described above (shock, expansion).

Attention is drawn to the fact that the tension can also be achieved with or more spring members, which can be configured as torsion springs, in particular, and which can apply a force for tensioning the rotation hoop knife to at least one retaining member.

In another configuration of the invention, the housing has a base and at least one wall.

In this way, an inexpensive housing can be provided. The wall can cover the entire width of the rotation hoop knife to be received, in such a way that the housing can enclose the rotation hoop knife and is open only on the side that faces the splitting machine during mounting or dismantling.

In another configuration of the invention, the housing can be closed by means of a housing cover when the rotation hoop knife has been installed.

The rotation hoop knife can thus be transported inside the closed transport device, while the cover can be removed during cleaning or sterilization in order to allow better access for cleaning agents and steam.

In another configuration of the invention, the rotation hoop knife is firstly positioned on the discs in such a way that a pair of mutually assigned openings are opposite each other. To this end, a suitable marking that makes this position visually recognizable can be provided on the splitting machine. A longitudinal, rod-shaped retaining member is then inserted through a pair of associated openings in order to hold the rotation hoop knife at the openings by the ends of the retaining members.

In another configuration of the invention, the rotation hoop knife is detensioned in the splitting machine during dismantling of the rotation hoop knife and after tensioning the rotation hoop knife on the transport device by means of the retaining members.

This ensures that the rotation hoop knife is transferred in the tensioned state from the transport device.

In another embodiment of the invention, the rotation hoop knife is tensioned in the splitting machine during mounting of the rotation hoop knife, before the rotation hoop knife is de-tensioned by means of the retaining members in the transport device.

This ensures that the rotation hoop knife is transferred in the tensioned state from the splitting machine.

It is self-evident that the features as mentioned above and to be explained below can be applied not only in the combination specified in each case, but also in other combinations or in isolation, without departing from the scope of the present invention.

BRIEF DESCRIPTION OF THE DRAWINGS

Embodiments of the invention are shown in greater detail in the drawings and shall now be explained in more detail. In the drawings.

DETAILED DESCRIPTION OF THE PREFERRED EMBODIMENT

Figure 1:
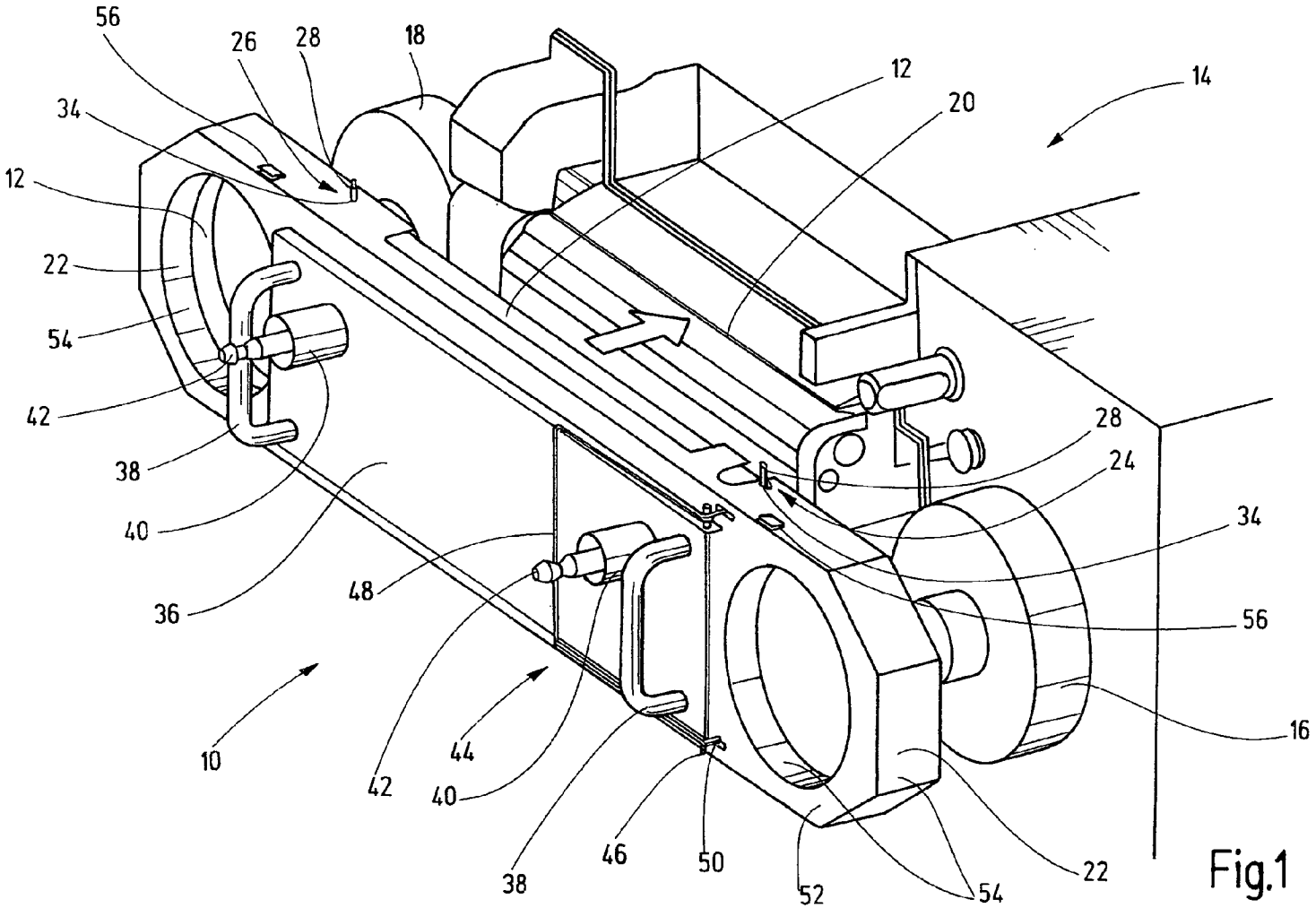
FIG. 1 shows a front view of a transport device, with a rotation hoop knife contained therein which is to be mounted on a splitting machine.

FIG. 1 shows a transport device 10 for mounting a rotation hoop knife 12 on a splitting machine 14. Since the operating principle of a splitting machine 14 is known, only discs 16, 18 and splitting region 20 are marked with reference numerals.

The aim of mounting rotation hoop knife 12 is to tension the rotation hoop knife 12 around discs 16, 18.

The transport device 10 shown has a housing 22 and two retaining members 24, 26. Each of the retaining members 24, 26 has two ends 28 which are used to hold the rotation hoop knife 12. In the view shown, only one end 28 of each retaining member 24, 26 is visible.

Retaining members 24, 26 are embodied as elongate rod-shaped members which are guided substantially parallel to each other. Retaining members 24, 26 are guided in cutouts 34 in housing 22. In the view shown, only the upper cutouts 34 can be seen, whereas the lower cutouts 34 are hidden on the reverse side of housing 22. In the transport device 10 shown here, retaining members 24, 26 can be pulled out of cutouts 34.

A support member 36 with two grip members 38 is disposed on housing 22. Support member 36 is also provided with guide sleeves 40. In co-operation with guide bolts 42, which are fixed to the splitting machine 14, it is thus possible to position transport device 10 with precision relative to the splitting machine 14 and in particular to discs 16, 18. and splitting region 20.

Transport device 10 also has a clamping member 44. This clamping member 44 is pivotably mounted about an axis 46 and is embodied as a yoke (in this case a wire yoke). Clamping member 44 has a grip portion 48 and a lever portion 50, although in this view lever portion 50 is mostly hidden by housing 22.

Clamping member 44 allows retaining members 24, 26 to be displaced relative to each other. In the embodiment shown here, the displacement relative to each other is effected by displacing retaining member 24. However, such displacement can also be achieved by moving both retaining members 24, 26. The principle by which clamping member 44 operates shall be explained in greater detail further below.

Housing 22 has a base 52 and walls 54. Housing 22 is also provided with fixing regions 56 to which a housing cover 58 (shown symbolically in FIG. 2) for covering housing 22 can be fixed.

It is advantageous when the housing cover 58 is fixed by means of clip members. Such a housing cover 58 would be fixed to the reverse side of the transport device 10 shown in FIG. 2.

Figure 2:
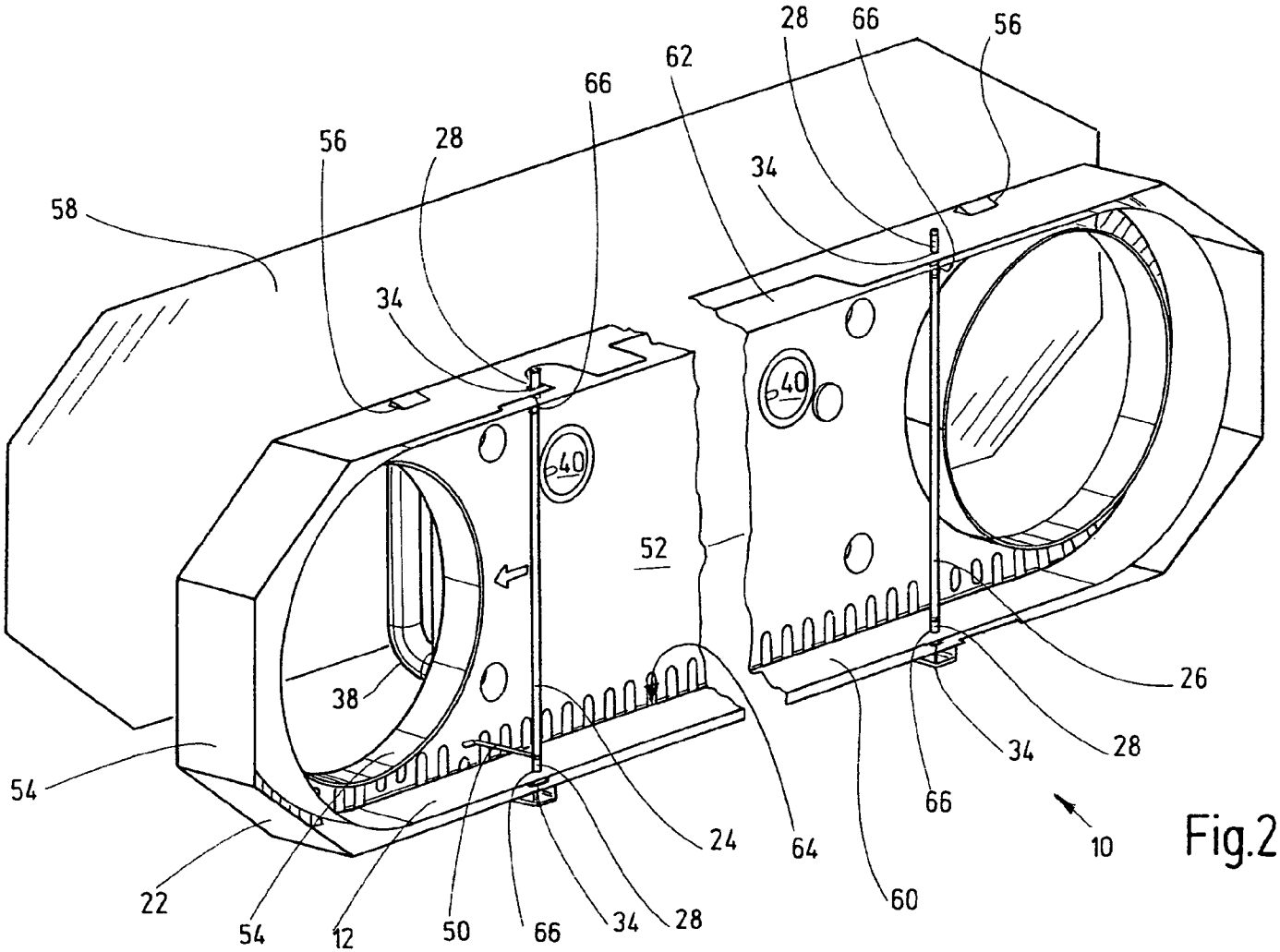
FIG. 2 a view from the back of this transport device, with a rotation hoop knife contained therein.

FIG. 2 shows a view of the reverse side of transport device 10. The holding assembly for holding rotation hoop knife 12 can now be seen better. Rotation hoop knife 12 has an inner and an outer strip surface 60, 62. The front end facing base 52 is embodied as a cutting edge 64. Openings 66 are disposed on strip surface 60 and are embodied here as through-holes.

When reference to a pair of openings 66 is made below in connection with this embodiment, then what is meant are openings 66, which are positioned opposite each other in relation to a longitudinal axis of the rotation hoop knife accommodated in its transportable state in transport device 10.

If one looks at the positioning of any retaining member 24, 26, one can see that retaining members 24, 26 are each guided in an upper and a lower cutout 34 in housing 22 and pass through the respectively assigned pair of openings 66.

The special aspect here is that the rotation hoop knife 12 touches retaining members 24, 26 only at very small contact surfaces. Additional contact, particularly with housing 22, can thus be avoided. By this means, rotation hoop knife 12 can be cleaned and sterilized very well inside the transport device 10, on the one hand. On the other hand, rotation hoop knife 12 can be protected against possible mechanical damage that might arise as a result of coming into contact with housing 22.

One can also see that the lever member 50 of clamping member 44, in the tensioned state, exerts a force in the direction of the arrow both in the upper region (hidden here) and in the lower region of retaining member 24. By this means, rotation hoop knife 12 is held in a tensioned state inside transport device 10.

Figure 3:
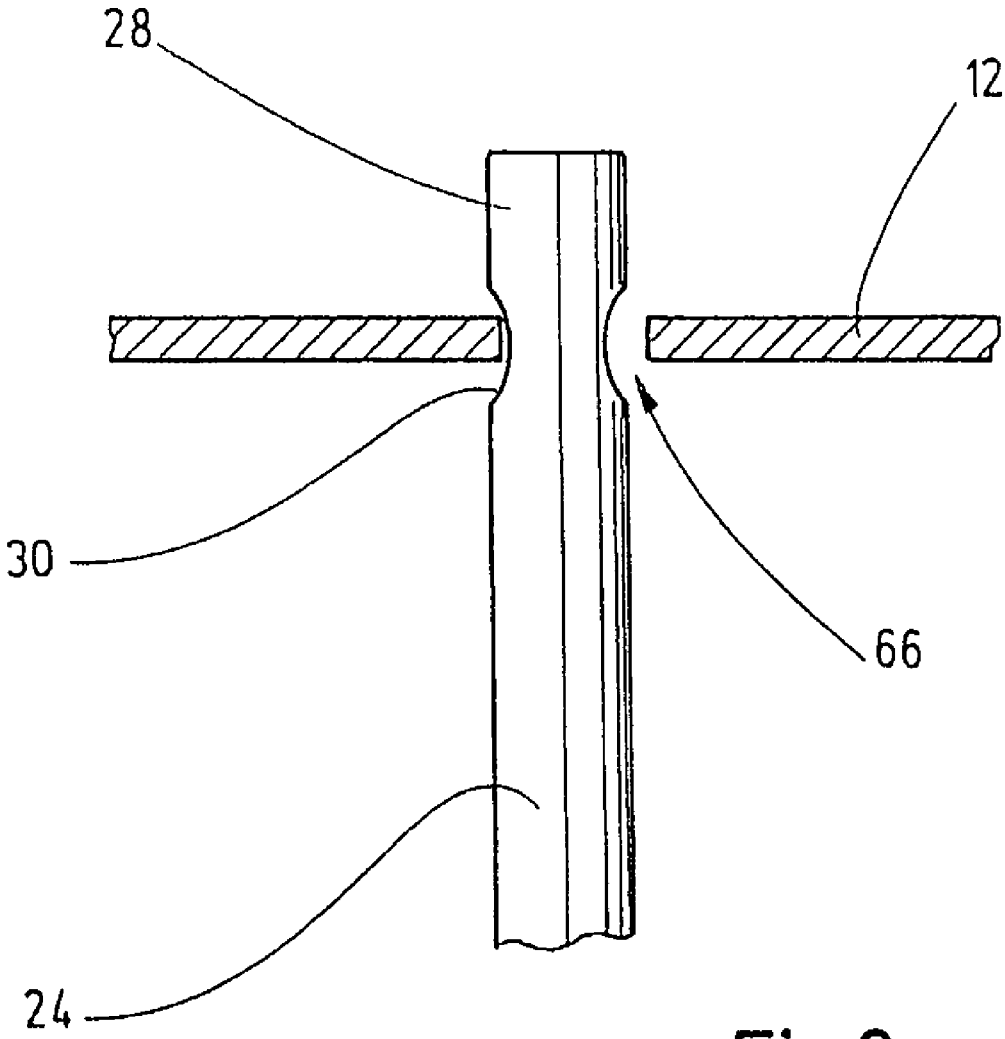
FIG. 3 shows a detailed view of a retaining member in an opening in the rotation hoop knife.

FIG. 3 shows a detailed view of retaining member 24, whose end 28 has a peripheral groove 30. The figure shows the state after retaining member 24 has passed through opening 66 and clamping member 44 has been tensioned. It can be seen that an edge of opening 66 now lies in peripheral groove 30. By this means, any movements of rotation hoop knife 12 along retaining member 24 are prevented, in this case in the vertical direction.

Attention is drawn once again, with reference to FIG. 3, to the fact that the rotation hoop knife 12 contacts the retaining members 24, 26 only at very small contact points.

Now that the figures have been explained, a method for mounting a rotation hoop knife 12 shall now be described by way of an example.

FIG. 2 shows the position in which the rotation hoop knife 12 has been transported inside transport device 10. The housing cover 58 has already been removed from the reverse side of transport device 10, visible in this figure.

Discs 16, 18 of splitting machine 14 are in a position in which rotation hoop knife 12 can be mounted, i.e. one of the discs 16, 18 has been moved a certain amount in the direction of the other disc into a de-tensioned position.

By means of grip members 38, the transport device 10 is positioned in such a way relative to the splitting machine 14 that the guide bolts 42 can be guided into guide sleeves 40. This ensures that the rotation hoop knife 12 is correctly positioned relative to discs 16, 18 and splitting region 20.

The transport device 10 is then pushed in the direction of the splitting machine 14 to such an extent that the rotation hoop knife 12 is positioned radially spaced apart from, and possibly touching the peripheral surfaces of discs 16, 18.

The rotation hoop knife 12 is now tensioned on splitting machine 14 by increasing the distance between discs 16, 18.

During transportation, the rotation hoop knife 12 was held in a tensioned state inside transport device 10. This tension is now released by pulling on the grip member 48 of clamping member 44. Since the rotation hoop knife 12 is already held on discs 16, 18 of the splitting machine, the retaining members 24, 26 can now be withdrawn.

The transport device 10, without the rotation hoop knife 12, can now be removed. In this way, a sharp rotation hoop knife 12 can be safely mounted on a splitting machine 14 without the rotation hoop knife 12 itself having to be touched.

In order to dismantle the rotation hoop knife 12 from the splitting machine 14, the procedure described above is performed in reverse order.

The transport device 10, guided by guide bolts 42, is first pushed so far onto the splitting machine 14 that the transport device 10 is placed over the rotation hoop knife 12. The retaining members 24, 26 are then introduced into the cutouts 34 of housing 22 in such a manner that they each pass through a pair of openings 66 in rotation hoop knife 12 as well.

In the next step, grip portion 48 of clamping member 44 is pressed down in order to tension the rotation hoop knife 12 inside the transport device 10. After that, the rotation hoop knife 12 is released from the splitting machine 14 by moving discs 16, 18 towards each other. When the rotation hoop knife 12 has been released in this way, it is now supported by retaining members 24, 26.

After the transport device 10 has been removed, housing 22 can be closed with housing cover 58, such that the rotation hoop knife 12 can be safely transported.

The invention allows a sharp rotation hoop knife to be transferred without risk to the user between different devices, for example between a grinding machine and a splitting machine, and also allows a sharpened rotation hoop knife to be cleaned and sterilized. A suitable grinding machine is embodied with two discs onto which a rotation hoop knife can be mounted in the same manner as onto a splitting machine. The blade is set in motion and sharpened on the grinding machine.

After the sharpening process, the sharpened rotation hoop knife can be removed by means of the transport device in the same manner as with a splitting machine, then cleaned and sterilized inside the transport device. Finally, the rotation hoop knife is mounted on the splitting machine by means of the transport device.

The invention provides the option of no longer having to sharpen the rotation hoop knife on the splitting machine. Since sharpening can now be carried out in a different area or in a different room, and the sharp rotation hoop knife can nevertheless be safely transported, it is now possible to mount sharp rotation hoop knifes under cleanroom conditions.

The invention claimed is:

1. A transport device for an endless rotation hoop knife, comprising:

a housing comprising a cavity for receiving an endless rotation hoop knife therein; and at least two retaining members which are configured for engaging openings provided in said rotation hoop knife for securing said rotation hoop knife within said cavity of said housing;

wherein said retaining members are held detachably within cutouts provided within said housing;

wherein said retaining members are configured as elongate rod-shaped members, and each of said retaining members comprises a first peripheral groove at a first end thereof, and comprises a second peripheral groove at a second end, said peripheral grooves being configured for engaging said openings in said rotation hoop knife.

2. The transport device of claim 1, wherein:

the endless rotation hoop knife is configured as an endless strip having at least one sharpened cutting edge and at least two openings extending through said strip; and the housing cavity receives said endless rotation hoop knife in a transport mode being non-operable for cutting, independently from a device on which said rotation hoop is operable for cutting.

3. The transport device of claim 1, wherein said retaining members are guided within said housing substantially parallel to each other.

4. The transport device of claim 1, further comprising a clamping member for securing said rotation hoop knife in a tensioned state inside said cavity of said housing; wherein said clamping member is configured as a yoke held on said housing pivotably about an axis.

5. The transport device of claim 4, wherein said clamping member comprises a grip portion that is arranged outside said housing and a lever portion held within said cavity of said housing for engaging one of said retaining members.

6. The transport device of claim 4, further comprising a cover configured for attaching to said housing for closing said cavity to the outside.

7. The transport device of claim 1, wherein said endless rotation hoop knife comprises two pairs of openings, wherein each of said retaining members engages two openings of one of said two pairs of openings.

8. The transport device of claim 7, wherein said rotation hoop knife comprises two elongate edges opposite each other, a first one of said edges being configured as a cutting edge, a second one of said edges being configured as a blunt edge;

wherein said openings are disposed in the middle between said cutting edge and said blunt edge.

* * * * *